United States Patent [19]

Koyano

[11] 4,454,386

[45] Jun. 12, 1984

[54] PIEZOELECTRIC TRANSDUCER FOR PIEZOELECTRIC LOUD SPEAKER

[75] Inventor: Akio Koyano, Osaka, Japan

[73] Assignee: Sumitomo Special Metal Co., Ltd., Osaka, Japan

[21] Appl. No.: 314,873

[22] Filed: Oct. 26, 1981

[30] Foreign Application Priority Data

| | | | |
|---|---|---|---|
| Oct. 29, 1980 | [JP] | Japan | 55-152618 |
| Nov. 25, 1980 | [JP] | Japan | 55-166044 |
| Dec. 8, 1980 | [JP] | Japan | 55-173373 |
| Dec. 9, 1980 | [JP] | Japan | 55-174425 |
| Feb. 23, 1981 | [JP] | Japan | 56-25886 |

[51] Int. Cl.[3] ..... H04R 17/00

[52] U.S. Cl. ..... 179/110 A; 310/367

[58] Field of Search ..... 179/110 A; 310/367, 310/368, 369

[56] References Cited

U.S. PATENT DOCUMENTS

| | | | |
|---|---|---|---|
| 1,967,839 | 7/1934 | Osnos | 310/367 |
| 2,485,722 | 10/1949 | Erwin | 310/367 |
| 3,629,625 | 12/1971 | Schafft | 310/8.6 |

OTHER PUBLICATIONS

*Elements of Acoustical Engineering*, Harry F. Olson, 1947, RCA Laboratories, Princeton, NJ, pp. 224–225.

*Primary Examiner*—A. D. Pellinen
*Assistant Examiner*—Danita R. Byrd
*Attorney, Agent, or Firm*—Watson, Cole, Grindle & Watson

[57] ABSTRACT

A piezoelectric transducer for use in a piezoelectric loud speaker includes a metallic plate and a piezoelectric wafer fixed to at least one face of the metallic plate, a first end of the piezoelectric transducer being adapted to be clamped to the frame of the loud speaker and a second end being adapted to be connected to a cone diaphragm in the loud speaker, the ratio of the width of the transducer at its first end being less than its maximum width, and the ratio of as maximum width to its effective length being between 0.75 and 3.

11 Claims, 19 Drawing Figures

FIG. 1
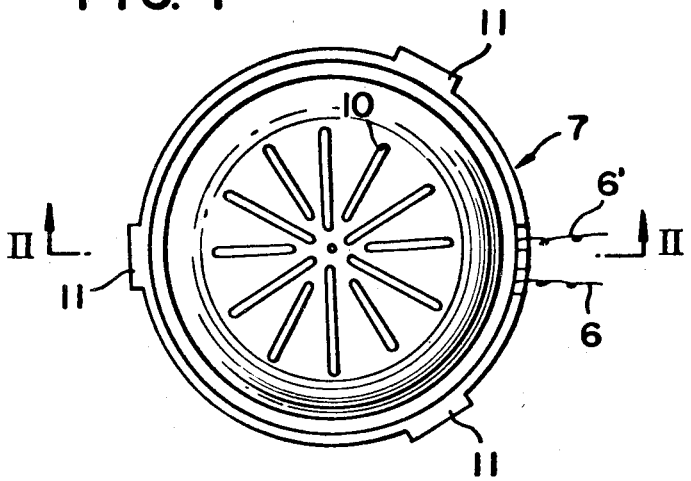
FIG. 2
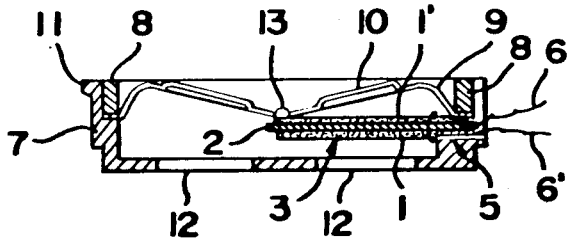
FIG. 11
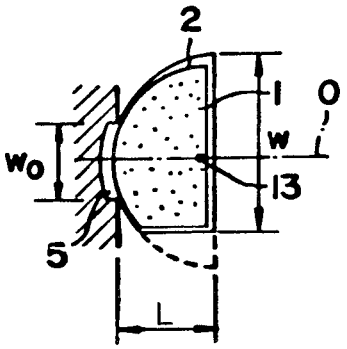
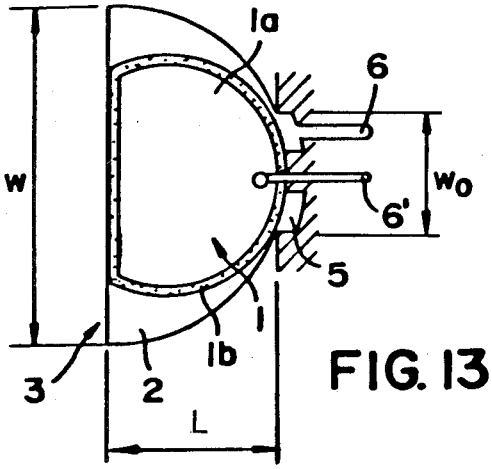
FIG. 13

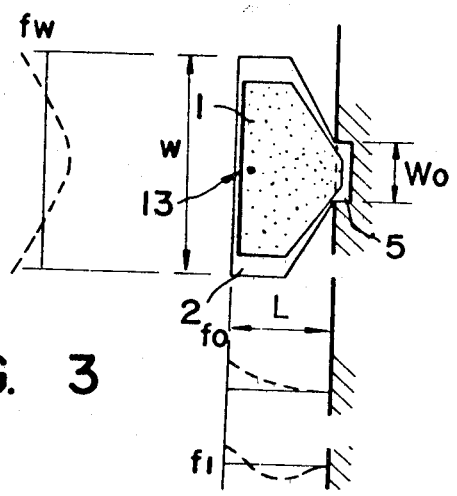
FIG. 3
FIG. 7A
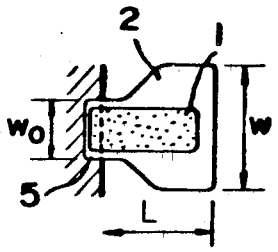
FIG. 7C
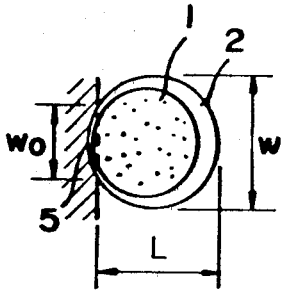
FIG. 7B
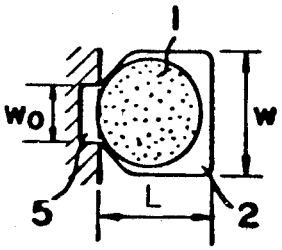
FIG. 7D1
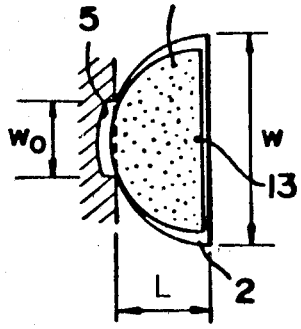

PIEZOELECTRIC TRANSDUCER FOR PIEZOELECTRIC LOUD SPEAKER

FIELD OF THE INVENTION

The present invention relates to piezoelectric transducer elements, and more particularly to piezoelectric transducer elements useful in driving sound-producing elements in piezoelectric loud speakers.

DESCRIPTION OF THE PRIOR ART

Piezoelectric transducers which can be used to drive the sound-producing elements in piezoelectric loud speakers are known. These piezoelectric transducers (hereinafter called "transducers," or "transducer" in the singular) normally are constructed of at least one piezoelectric wafer mounted on a metallic plate; however, different types of such transducers are known.

In U.S. Pat. Nos. 3,548,116 and 3,629,625 transducers are disclosed of the disc-type Bimorph variety which are constructed of two disc-shaped piezoelectric wafers separated by a disc-shaped metallic plate. A vibratory bending occurs in these transducers when a voltage is impressed on the piezoelectric wafers, and the result is a driving force on the sound-producing element to which they are associated. This in turn will result in the creation of an audible sound wave emitted from the loud speaker.

The lower limit to the sound frequencies which the sound-producing element in the loud speaker will be capable of producing will be dependent on the fundamental resonant frequency, $f_o$, of the transducer which is associated therewith. For example, if the piezoelectric wafers of the disc-type Bimorph transducer and the metallic disc sandwiched therebetween have outside diameters of 24.3 mm and each of the wafers and the plate have equal thicknesses of 0.15 mm, the lowest sound frequency which the associated sound-producing element will be able to reproduce will be about 4,000 Hz. In order that these transducers be usable in conjunction with sound-producing elements intended to reproduce the lowest sound frequencies in the voice range, i.e., about 400 Hz, their resonant frequencies must be reduced by a factor of ten.

Now the resonant frequencies of these transducers will be directly proportional to their thicknesses and inversely proportional to the square of their diameters. Thus, if the thickness of the transducer is kept constant, to lower the resonant frequency by a factor of ten would require the diameter thereof to be about 77 mm. However, the piezoelectric wafers are usually made of a piezoelectric lead-titanate-zirconate ceramic (with silver electrode bonded on both faces), and it is difficult to manufacture wafers with such diameters and in addition they will be easily broken. The practical limit to the diameter of such piezoelectric wafers is about 30 mm.

Although the resonant frequency could also be reduced by reducing the thickness of the wafers, to lower the $f_o$ by a factor of ten would require the ceramic wafer to have a thickness of 0.015 mm, which is quite impractical. The minimum practical thickness is about 0.08 mm.

Thus, disc-type Bimorph transducers are normally only used in conjunction with the high frequency-reproducing tweeters in loud speakers.

Another type of transducer, i.e., a rectangular cantilever-type Bimorph transducer, is shown in U.S. Pat. No. 3,577,020. This transducer, which is constructed of a rectangular metallic plate and separate rectangular piezoelectric wafers attached to its opposite faces, is adapted to be rigidly clamped at one end of the frame of the loud speaker and at its opposite end attached to the speaker cone diaphragm. This rectangular cantilever-type Bimorph transducer can display a resonant frequency of about ¼ that of a disc-type Bimorph transducer. However, such rectangular cantilever type Bimorph transducers are not powerful enough to drive speaker cones intended to reproduce low frequency audible sounds. Their main use has been in microphones as sound-receiving elements. However, their use in microphones has been less than totally desirable as transducers in microphones should really have relatively high resonant frequencies for best action.

Thus, it is an object of the present invention to provide transducers which are useful in driving the sound-producing elements in loud speakers. More particularly, it is an object of the present invention to provide transducers of the cantilever Bimorph type which can be used to drive the sound-producing elements of loud speakers intended to reproduce the frequencies associated with the lower end of the audible range.

SUMMARY OF THE INVENTION

According to the present invention, a cantilever Bimorph transducer, i.e., a first which has one end adapted to be clamped to the frame of the speaker cone and a second (vibration) end adapted to be attached to a cone speaker, and which comprises a metallic plate and a piezoelectric wafer attached to at least one face thereof, is shaped and dimensioned such that the ratio of its maximum width to its effective length, this being the distance between the point where its first end is clamped to the speaker frame and its second end, ranges from 0.75 to 3 and the ratio of its width at the point where its first end is clamped to the speaker frame to its maximum width is less than 1.

BRIEF DESCRIPTION OF THE DRAWINGS

FIG. 1 is a plan view of a piezoelectric loud speaker employing a transducer constructed according to the present invention.

FIG. 2 is a sectional view taken on line II—II of FIG. 1.

FIG. 3 is a diagram illustrating the fundamental shape of a transducer according to the present invention.

FIGS. 7A to 7D are plan view representing embodiments of transducer constructed according to the invention.

FIG. 11 is a plan view representing a further embodiment of a transducer constructed according to the present invention.

FIG. 13 is a plan view of another transducer constructed according to another embodiment of the invention.

DETAILED DESCRIPTION OF THE PREFERRED EMBODIMENTS

Figure 4:
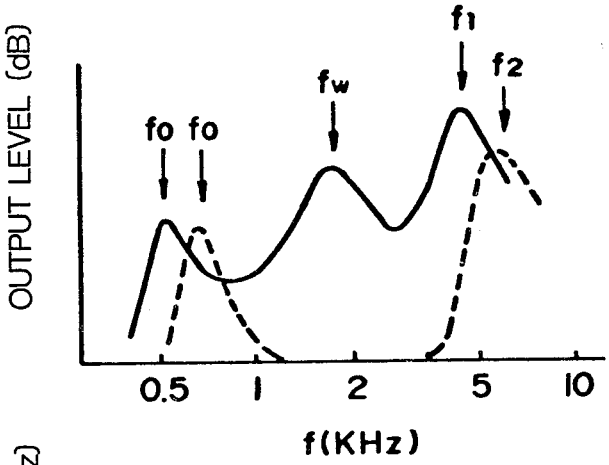
FIG. 4 is a graph illustrating an output characteristic of the transducer shown in FIG. 3.

A piezoelectric loud speaker which employs a transducer constructed in accordance with the present invention is shown in FIGS. 1 and 2. The loud speaker is seen to include a frame 7, a gasket 8 (each of the frame 7 and gasket 8 being formed of molded acrylonitrile styrene-butadiene copolymer resin), and a cone diaphragm 9. The cone diaphragm 9, which includes a plurality of radial ribs 10 on its top (as seen in FIG. 2) surface for reinforcement, has its outer periphery clamped between the frame 7 and gasket 8. The molded frame 7 includes projections 11 extending away from its upper (as seen in FIG. 2) end to enable its mounting on the desired support (not shown), and it also is formed to include air vents 12 along its lower (rear) side. A transducer 3, constructed in accordance with the present invention to include piezoelectric wafers 1 and 1' on opposite faces of a metallic plate 2, is positioned to extend from end 5 between the frame 7 and gasket 8 to the center 13 of the cone diaphragm 9. A lead wire 6 connects to the metallic plate 2 of the transducer and the lead wire 6' connects with the piezoelectric wafers 1 and 1'. The piezoelectric wafers 1 and 1' are composed of either a barium-titanate ceramic or a lead-titanate-zirconate ceramic which are polarized in the direction of their thickness, and include silver electrodes fired to both faces. The metallic plate 2 is composed of a conductive material such as phosphor bronze, brass or aluminum, although a plastic sheet which has been metallized with a metallic film can also be used. The piezoelectric wafers are attached to the metallic plate by an epoxy resin which provides a strong bond therebetween.

The fundamental shape of the transducer according to the invention is shown in FIGS. 2 and 3. It should be noted that the transducer can be symmetric in shape, i.e., to include a metallic plate which includes a separate piezoelectric wafer on opposite faces, or asymmetric in shape, i.e., to include a metallic plate which includes a piezoelectric wafer on only one face thereof. The symmetric-type transducer will be capable of producing a powerful driving force while the asymmetric-type will correspondingly provide only about ½ the driving force; however, the asymmetric-types are nevertheless of value insofar as they are less costly to produce.

When an electrical signal is impressed on the inventive transducer of the symmetric variety, one piezoelectric wafer elongates lengthwise of the transducer and the other wafer contracts, the transducer thus generating a bending vibration related to the electrical signal. The cone diaphragm to which the transducer is attached will vibrate in a vertical (as seen in FIG. 2) direction and radiate an associated sound wave.

On the other hand, if the transducer is of the asymmetric variety, the one piezoelectric wafer will elongate (the metallic plate remaining unchanged in length) and a bending vibration similar to that achieved with a symmetric variety transducer will be achieved. The present invention transducers will be hereinafter discussed in detail with respect to the asymmetric variety.

It was discovered by the inventor that a piezoelectric loud speaker could generate a better sound if the vibration end of the transducer attached to the cone diaphragm was widened. It is believed that while the sound output of the cone diaphragm depends only upon the bending vibration occurring longitudinally of the transducer in the case of a conventional rectangular transducer, if the transducer is altered in shape, such that it has an increased width at its vibration end in contact with the cone speaker, the sound output of the cone diaphragm will be a result of both the bending vibration acting both longitudinally and through the width of the transducer. The sound output from the cone diaphragm will be maximized when the bending vibration of the transducer is maximized. However, the conventional rectangular transducer has no resonance point in the voice band other than at the fundamental resonance frequency, $f_0$, and at the primary higher resonance frequency, $f_1$. Since the frequencies $f_0$ and $f_1$ have quite different values, a deterioration in the sound output occurs at frequencies therebetween.

The transducers of the present invention include a bending resonance frequency, $f_W$, between the frequencies $f_0$ and $f_1$, and thus the average sound output in the band between $f_0$ and $f_1$ is improved. A vibrating displacement of $f_0$, $f_1$, $f_w$ is shown in dotted lines in FIG. 3. As the result of equivalent mass of the transducer increasing and $f_0$ value decreasing, the regeneration bandwidth is enlarged. The result is given in FIG. 4.

The gist of the invention is therefore to arrange effectively the bending resonance frequency $f_W$ in the width direction according to the width W between the longitudinal bending resonance frequencies $f_0$, $f_1$, which are determined by an effective length L of the transducer.

If the effective length of the transducer is L, the thickness t, the velocity of sound of the bending vibration v, and $\alpha_L$ a constant, a longitudinal bending resonance frequency $f_L$ of the transducer for $f_0$, $f_1$ is obtainable by:

$$f_L=\alpha_L^2 t/2\pi L^2\cdot v \quad (1)$$

Then, with a maximum width of the transducer W, and $\alpha_W$ a constant, the bending resonance frequency $f_w$ is given by:

$$f_w=\alpha_w^2 t/2\pi W^2\cdot v \quad (2)$$

From the equations (1), (2), $f_W$ is obtainable by the following equation:

$$(f_L/f_W)=(\alpha_L/\alpha_n)^2\cdot(W/L)^2 \quad (3)$$

Consequently, how $f_W$ is arranged with respect to $f_L$ is determined according to the dimensional ratio W/L of the transducer.

Figure 5:
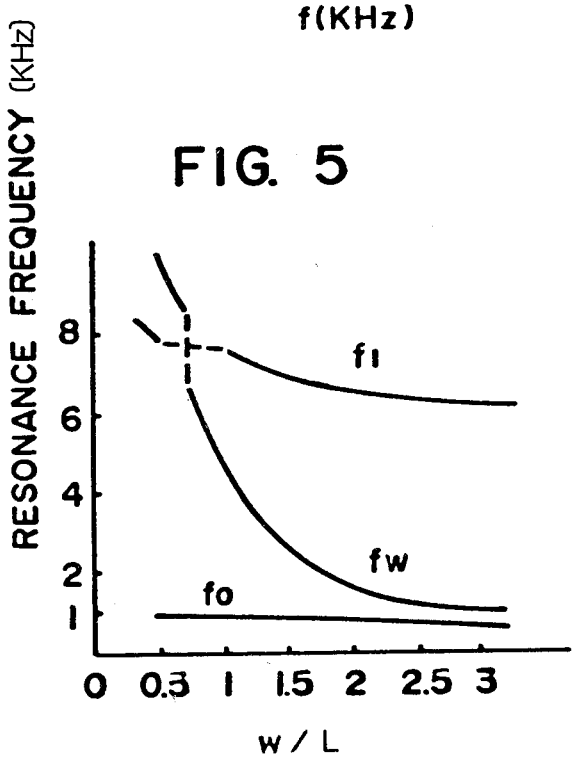
FIG. 5 is a graph illustrating the relationship between the dimensional ratio of the transducer and its resonance frequency.

The results obtained by measuring a distribution of the bending resonance frequencies when changing the value of the dimensional ratio W/L of the transducer is as shown in FIG. 5.

In FIG. 5 the transducer, which had a piezoelectric wafer 1 thickness and a metallic plate 2 thickness of 0.15 mm and an effective length L of 13 mm, was tested with a changing W. It was found that the bending resonance frequency $f_W$ was provided between $f_0$ and $f_1$ by selecting W/L in a range of 0.75 to 3, thereby improving the output characteristic of the transducer. Where $f_W$ comes very near to $f_0$ or $f_1$, the average output between $f_0$ and $f_1$ deteriorates. To improve the output in the voice band, it is preferably to arrange $f_W$ near $f_0$ on the low frequency side. In this regard the preferred ratio of W/L is from 1 to 2.75. Since an aural evaluation is actually more important than a theoretical one for arrangement of $f_W$, the frequency balance was evaluated aurally, and the optimum ratio of W/L was determined to be from 1.5 to 2.5.

On the other hand, the fixed end width, $W_0$, of the transducer (the end attached to the speaker frame) must be related to W such that $W_0/W<1$. Since the value $f_0$ becomes too large as $W_0/W$ approaches 1 and the reproducible bandwidth consequently narrows, whereas as $W_0/W$ approaches 0 to the output level at $f_0$ deteriorates, the preferred value of $W_0/W$ is $$0.2<(W_0/W)<0.8.$$

Further, since the speaker frame is generally round, in order to keep the transducer characteristics from deteriorating and in order to effectively mount the transducer at its fixed end to the round speaker frame, the optimum value of $W_0/W$ is $$0.3<(W_0/W)<0.6.$$

Figure 6:
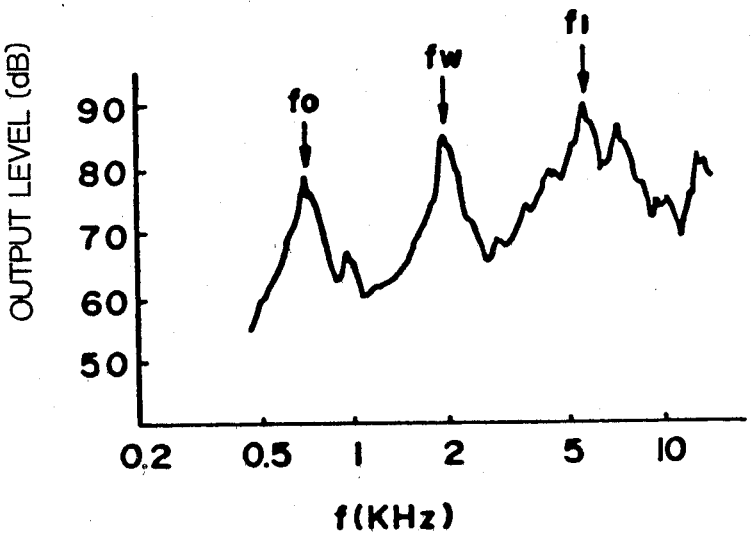
FIG. 6 is a further graph illustrating an output characteristic of the transducer shown in FIG. 3.

FIG. 6 shows an output characteristic of the loud speaker which is obtained when the transducer is constructed in the shape shown in FIG. 3, i.e., in asymmetric variety (with one piezoelectric wafer), wherein the piezoelectric wafer 1 and the metallic plate 2 are both 0.15 mm in thickness, W is 24 mm, L is 13 mm, $W_0$ is 10 mm and the length of the vibrating end expansion of the transducer is 8 mm. FIG. 6 is a graph obtained by measuring the sound pressure level at a distance 10 cm on the central axis of the front of loud speaker by applying a 1 V r.m.s. convection voltage on the transducer.

It is seen that $f_W$ was effectively provided between $f_0$ and $f_1$, thereby improving the sound pressure level.

However, the transducer of FIG. 3 is polygonal and this is unfortunately not easily mass produced.

The preferable transducer according to the invention thus differently shaped. As shown in FIG. 7A, the corners of the metallic plate may be rounded and the piezoelectric wafer rectangular in shape, or as shown in FIG. 7B the piezoelectric wafer may be in the form of a disc, or as shown in FIG. 7C both the metallic plate 2 and the piezoelectric wafer may be in the form of a disc, or as shown in FIG. 7D both the metallic plate 2 and the piezoelectric wafer may be semicircular in shape.

Figure 8:
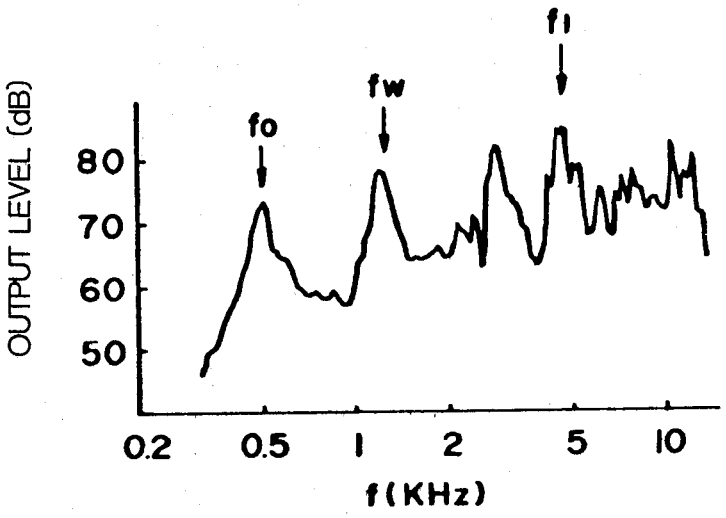
FIG. 8 is a graph illustrating an output characteristic of the transducer shown in FIG. 7D.

An output characteristic representative of these transducer constructions was measured from a speaker using a transducer having a shape as shown in FIG. 7D, the piezoelectric wafer 1 and the metallic plate 2 therein having semicircle radius of 25 mm, a thickness of 0.1 mm, W of 25 mm, L of 13 mm and $W_0$ of 10 mm. The results shown in FIG. 8, show that $f_W$ was provided between $f_0$, $f_1$, and a regenerating output was obtainable from about 400 Hz.

Figure 9A:
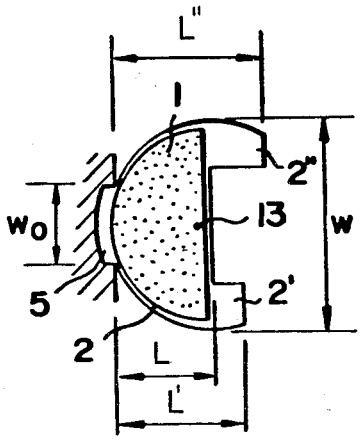
FIGS. 9A to 9C are plan views representing further embodiments of transducers constructed according to the present invention.
Figure 10:
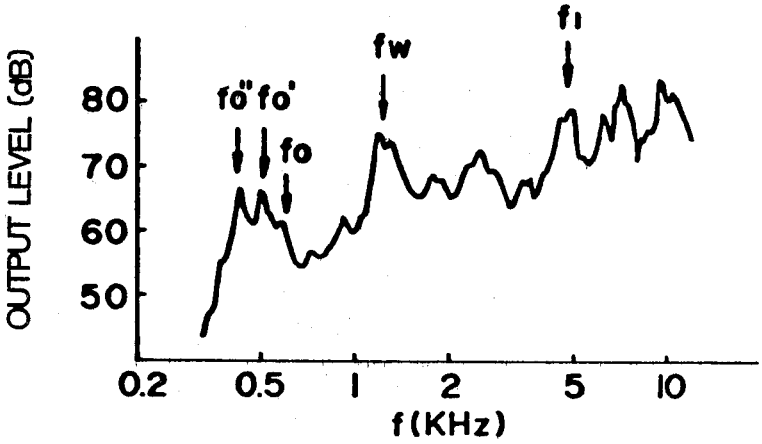
FIG. 10 is a graph illustrating an output characteristic of the transducer shown in FIG. 9A.

FIG. 9A shows a transducer constructed according to another embodiment of the present invention, which is partly elongated longitudinally to provide an enlarged frequency characteristic on the low band side. FIG. 10 shows the results obtained by measuring a frequency characteristic of the transducer with the piezoelectric wafer 1 and the metallic plate 2 having a semicircular radius of 25 mm, a thickness of 0.1 mm, W of 25 mm, L of 13 mm and $W_0$ of 10 mm, wherein the vibrating end of the metallic plate 2 has a width of 5 mm at two spots as illustrated, one end projection 2' being 17.5 mm in length L' and the other end projection 2'' being 20 mm in length L''.

Figure 9B:
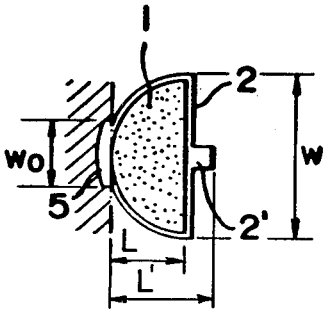
Figure 9C:
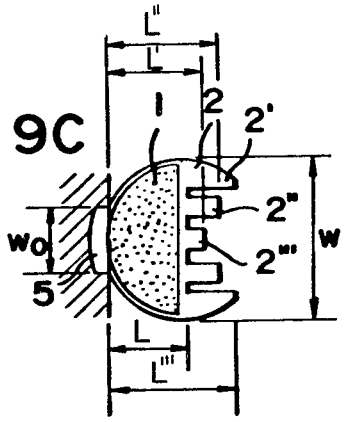

As will be apparent from the drawing, there results a resonance $f_0'$ based on the length L' and a resonance $f_0''$ based on L'' other than $f_0$, and thus the regeneration band is expanded further on the low band side. Thus, it is conceivable that the band can be further widened by elongating the transducer partly from a junction 13 with a cone diaphragm. The transducer is elongated at two spots in FIG. 9A; however, the end projection can in principle be taken in one spot only, as shown FIG. 9B or in two or more spots as shown in FIG. 9C.

Further, as shown in FIG. 11, the shape of the transducer 3 can be made asymmetric with respect to the longitudinal central axis 0.

With the shape thus asymmetric to the central axis 0, the vibration mode is reduced as compared to the symmetric type in FIGS. 3 and 7 is separated and the resonance point increases. Consequently, the frequency characteristic is essentially flattened. A loud speaker which was fabricated by using the transducer shaped as shown in FIG. 11, the piezoelectric wafer 1 and the metallic plate 2 having a radius of 25 mm, a thickness of 0.1 mm, W of 20 mm, L of 13 mm and $W_0$ of 10 mm showed a frequency characteristic as shown in FIG. 12.

Figure 12:
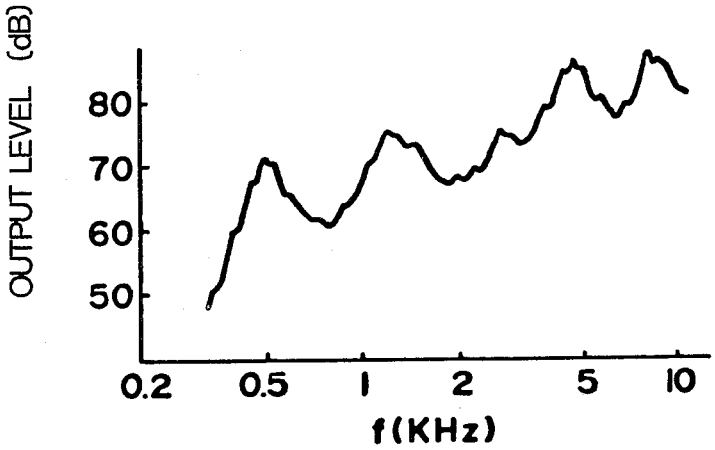
FIG. 12 is a graph illustrating an output characteristic of the transducer shown in FIG. 11.

As the result of shrunken vibration mode having been separated as illustrated in FIG. 12, the frequency characteristic is flattened as compared with the case of FIG. 8 which represents an output characteristic of the symmetric transducer.

Now the shape will have to be made asymmetric with reference to the central axis 0 for the asymmetric mode. Therefore, the shape of the piezoelectric wafer 1 and the metallic plate 2 can be each made independently asymmetric with respect to the central axis 0, or a similar effect to FIG. 12 can be obtained by achieving a fixed position of the piezoelectric wafer out of the central axis 0.

Figure 14:
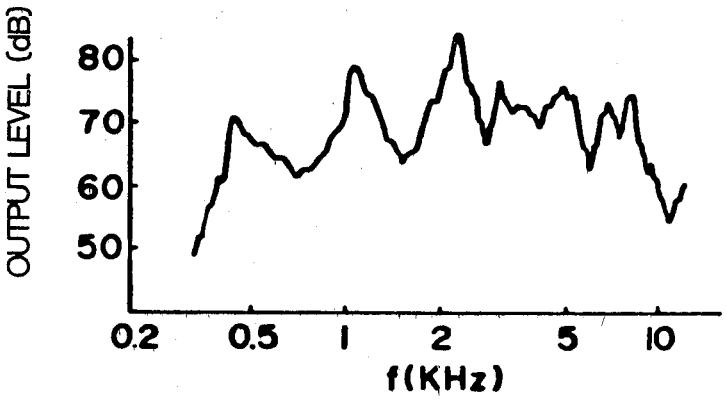
FIG. 14 is a graph illustrating an output characteristic of the transducer shown in FIG. 13.

Next, an operative example of a transducer according to the present invention will be described with reference to a piezoelectric speaker shown in FIG. 2 using the transducer shown in FIG. 13. FIG. 14 thus represents an output characteristic of the speaker, which indicates a sound pressure level measured at a spot 10 cm on the front axis of the speaker by applying a 1 V r.m.s. AC input voltage.

The illustrated embodiment includes a semicircular piezoelectric wafer 1 composed of a piezoelectric lead-titanate-zirconate ceramic, its radius being 25 mm, its thickness 0.1 mm with a silver electrode 1*a* (illustrated on one face only) fired on both faces and polarized, which wafer is fixed using an epoxy resin on a semicircular phosphor bronze plate which has a radius of 33 mm and a thickness of 0.1 mm. The effective length L of the transducer 3 is 17 mm, and the piezoelectric wafer 1 is partly cut to have a longitudinal dimension of 18 mm. The width $W_0$ of the fixed end 5 is 13 mm, the fixed end of the metallic plate 2 is extended partly to a lead wire 6, and a lead wire 6' is soldered on the piezoelectric wafer 1.

Acrylonitrile styrene-butadiene copolymer resin is used for the loud speaker frame and gasket, and the frame has a 40 mm outside diameter and a 3.5 mm height. The cone diaphragm is 35 mm in effective diameter with a 100 μm polyimide film thermally molded thereon, it has a height of 1.9 mm and it includes 12 reinforcing ribs which are 1.2 mm wide and 0.5 mm high.

The fixed end of the transducer is fixed on its top to the frame with epoxy resin, and epoxy resin is also used for fixing the cone diaphragm and the gasket. A 1 mm diameter is formed in the top of the cone diaphragm 9, and epoxy resin is dropped from the top to fix the diaphragm onto the transducer.

The obtained loud speaker is powerful enough to obtain a regenerative output at about 300 Hz or over (FIG. 14), and weighs only at 2.9 grams, which is about $\frac{1}{3}$ lighter than a conventional dynamic speaker.

What is claimed is:

1. A loud speaker which includes a frame, a sound-producing element mounted in the frame, and a piezoelectric transducer fixedly connected at its first end to said frame and at its second end to said sound-producing elements, said piezoelectric transducer having a width ($W_0$) at the point where its first end is clamped to the speaker frame, a maximum width (W) and an effective length (L) from the point where its first end is clamped to the speaker frame to its second end, said piezoelectric transducer being shaped and dimensioned such that its width ($W_0$) is less than its maximum width (W) and the ratio of its maximum width (W) to its effective length (L) is between 0.75 and 3.

2. The loud speaker as defined in claim 1 wherein the ratio of maximum width (W) to effective length (L) of said piezoelectric transducer is between 1 and 2.75, and wherein the ratio of width ($W_0$) to maximum width (W) is between 0.2 and 0.8.

3. The loud speaker as defined in claim 2 wherein the ratio of maximum width (W) to effective length L is between 1.5 and 2.5, and wherein the ratio of width ($W_0$) to maximum width (W) is between 0.3 and 0.6.

4. The loud speaker as defined in claim 1 wherein said piezoelectric transducer is shaped to be asymmetric with respect to an imaginary longitudinal center line therethrough.

5. The loud speaker as defined in claim 1 wherein said metallic plate and each piezoelectric wafer of said piezoelectric transducer are polygonal in shape.

6. The loud speaker as defined in claim 5 wherein each of the corners of the polygonal-shaped metallic plate and each piezoelectric wafer is rounded.

7. The loud speaker as defined in claim 1 wherein said metallic plate of said piezoelectric transducer is polygonal in shape with rounded corners, and each piezoelectric wafer is disc-shaped.

8. The loud speaker as defined in claim 1 wherein said metallic plate of said piezoelectric transducer is semicircular in shape and each said piezoelectric wafer is semicircular in shape.

9. The loud speaker as defined in claim 8 wherein said metallic plate includes at least one projection extending away from the second end thereof.

10. The loud speaker as defined in claim 1 including two piezoelectric wafers which are respectively connected to opposite faces of said metallic plate.

11. The loud speaker as defined in claim 1 wherein said sound-producing element is a cone diaphragm and wherein the second end of said piezoelectric transducer is connected to the center of said cone diaphragm.

* * * * *